US010252546B2

(12) United States Patent
Watanabe

(10) Patent No.: US 10,252,546 B2
(45) Date of Patent: Apr. 9, 2019

(54) LABEL PRINTER

(71) Applicant: TOSHIBA TEC KABUSHIKI KAISHA, Tokyo (JP)

(72) Inventor: Osamu Watanabe, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/797,237

(22) Filed: Oct. 30, 2017

(65) Prior Publication Data

US 2018/0043703 A1 Feb. 15, 2018

Related U.S. Application Data

(63) Continuation of application No. 15/204,492, filed on Jul. 7, 2016, now Pat. No. 9,827,787.

(30) Foreign Application Priority Data

Sep. 15, 2015 (JP) ..... 2015-181523

(51) Int. Cl.
*B41J 3/407* (2006.01)
*B41J 15/04* (2006.01)
(Continued)

(52) U.S. Cl.
CPC ..... *B41J 3/4075* (2013.01); *B41J 2/32* (2013.01); *B41J 11/42* (2013.01); *B41J 11/703* (2013.01); *B41J 15/042* (2013.01); *B41J 2202/31* (2013.01)

(58) Field of Classification Search
CPC ..... B41J 11/663; B41J 11/70; B41J 11/703; B41J 11/66; B41J 15/046; B41J 15/044; B41J 15/04; B41J 15/00
See application file for complete search history.

(56) References Cited

U.S. PATENT DOCUMENTS

2001/0007503 A1 7/2001 Inana
2010/0078869 A1 4/2010 Sanada et al.
2011/0200377 A1 8/2011 Iga

FOREIGN PATENT DOCUMENTS

JP 2001-278515 10/2001
JP 2011-167939 9/2011
(Continued)

OTHER PUBLICATIONS

Japanese Office Action dated May 8, 2018, filed in counterpart Japanese Patent Application No. 2015-181523 (6 pages) (with machine translation).

*Primary Examiner* — Kristal Feggins
(74) *Attorney, Agent, or Firm* — Kim & Stewart LLP

(57) ABSTRACT

A label printer according to an embodiment includes a support unit that supports a roll of a backless label paper; a conveying unit that conveys and reverse conveys the backless label paper along a conveying path; a printing unit positioned on the conveying path and including a print head that prints on a surface of the backless label paper; a cutting unit, positioned on the conveying path downstream of the printing unit in a conveying direction, that cuts the backless label paper; and a control unit that controls the conveying unit to reverse convey the backless label paper in a reverse conveying direction after the cutting unit cuts the backless label paper sheet so that a tip of the backless label paper is stopped at a predetermined position downstream from the print head in the conveying direction.

12 Claims, 12 Drawing Sheets

(51) Int. Cl.

| | |
|---|---|
| ***B41J 11/42*** | (2006.01) |
| ***B41J 11/70*** | (2006.01) |
| ***B41J 2/32*** | (2006.01) |

(56) References Cited

FOREIGN PATENT DOCUMENTS

| | | |
|---|---|---|
| JP | 2013-203013 | 10/2013 |
| JP | 2014-000716 | 1/2014 |

LABEL PRINTER

CROSS-REFERENCE TO RELATED APPLICATIONS

This application is a continuation of U.S. patent application Ser. No. 15/204,492, filed on Jul. 7, 2016, which is based upon and claims the benefit of priority from Japanese Patent Application No. 2015-181523, filed on Sep. 15, 2015, the entire contents of each of which are incorporated herein by reference.

FIELD

Embodiments described herein relate generally to a label printer.

BACKGROUND

A printer which prints on a backless label paper sheet is known. Such a label printer performs printing by pressing the backless label paper sheet which is conveyed by rotation of a platen roller, to a printing head.

When the printing is completed, the label printer cuts the backless label paper sheet, and a tip end of the cut backless label paper sheet is conveyed to a position at which the tip end is pushed against the printing head. Accordingly, when the next printing command is given, the label printer can print information from the tip end of the backless label paper sheet.

However, the backless label paper sheet may be attached to the platen roller when the tip end thereof is pushed against the platen roller by the printing head for a long period of time. In this state, when the platen roller conveys the backless label paper sheet by the rotation, the backless label paper sheet may become wound around the platen roller.

DETAILED DESCRIPTION

A label printer according to an embodiment includes a support unit that supports a roll of backless label paper; a conveying unit that conveys and reverse conveys the backless label paper along a conveying path; a printing unit positioned on the conveying path and including a print head that prints on a surface of the backless label paper; a cutting unit, positioned on the conveying path downstream of the printing unit in a conveying direction, that cuts the backless label paper; and a control unit that controls the conveying unit to reverse convey the backless label paper in a reverse conveying direction after the cutting unit cuts the backless label paper sheet so that a tip of the backless label paper is stopped at a predetermined position downstream from the print head in the conveying direction.

Hereinafter, with reference to the attached drawings, a label printer according to an embodiment will be described. The embodiment is an example label printer that issues a label or the like on which information associated with merchandise, such as foodstuff, is printed. However, the embodiment is not limited thereto, and the embodiment may be any apparatus that prints various information on a recording medium, such as a label paper sheet.

First Embodiment

Figure 1:
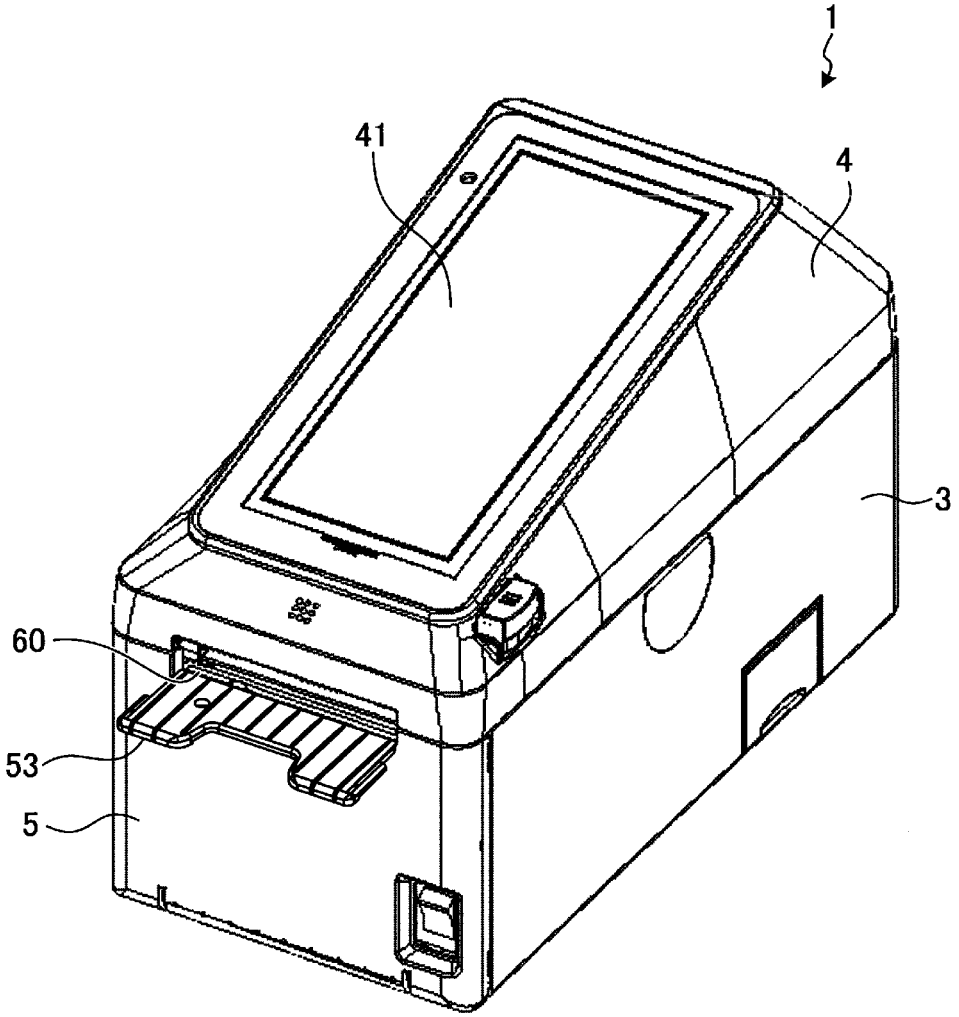
FIG. 1 is a perspective view of a label printer according to a first embodiment.
Figure 2:
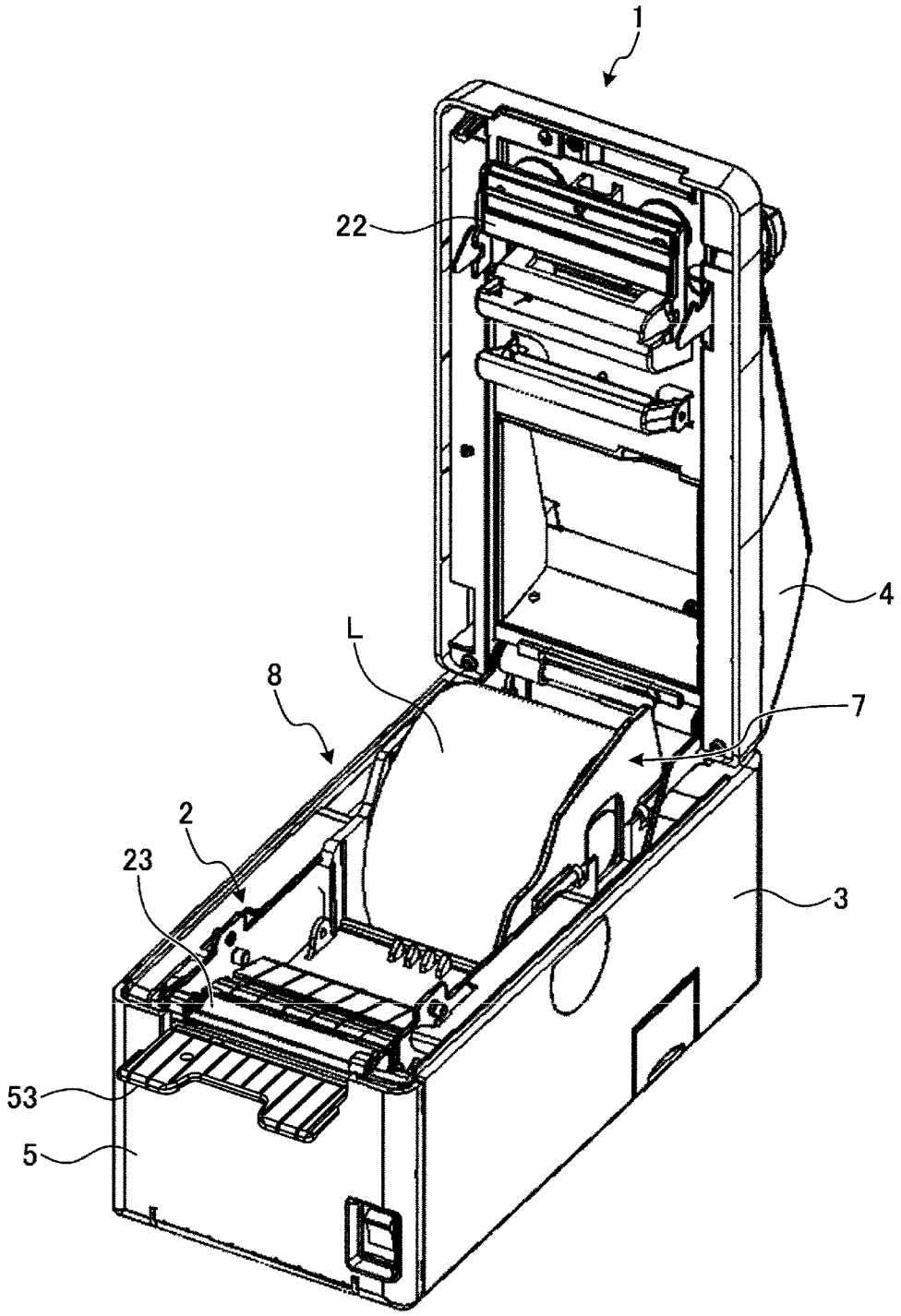
FIG. 2 is a perspective view of the label printer of FIG. 1 illustrating a state where an upper case of the label printer is opened.

FIG. 1 is a perspective view of a label printer 1 according to a first embodiment. FIG. 2 is a perspective view illustrating a state where an upper case 4 of the label printer 1 is opened.

The label printer 1 is provided with a printer main body 2. The printer main body 2 is covered with a lower case 3, an upper case 4, and a front cover 5, and is protected from impact or dust from the outside.

The label printer 1 is also provided with a backless label paper sheet L, a holder 7, and a support unit 8 inside the above-described printer main body 2. The holder 7 holds the backless label paper sheet L that is wound in a roll shape. The support unit 8 supports the holder 7 which holds the backless label paper sheet L. In addition, the support unit 8 can support the backless label paper sheet L without the holder 7.

The backless label paper sheet L is a long label paper sheet. The backless label paper sheet L is provided with an adhesive layer on a rear surface of a printing surface.

The lowercase 3 is a case in a rectangular parallelepiped shape in which an upper surface and a front surface are opened. The upper case 4 is moveable to close the upper surface of the lower case 3. The front cover 5 is moveable to close the front surface of the lower case 3. The lower case 3 is provided with a connection terminal (not illustrated) which is used in connecting the printer main body 2 to an external apparatus or a power terminal (not illustrated) which supplies power to the printer main body 2.

The upper case 4 is also provided with a touch panel display 41. The touch panel display 41 receives input of various operations and displays various information.

The front cover 5 is provided with a member 53 which receives a label after printing and cutting. The front cover 5 covers the front surface of the printer main body 2 and can be opened or closed with respect to the outside. In addition, the label printer 1 is provided with a label discharge port 60 which discharges the label, between an upper end unit of the front cover 5 and a front end lower unit of the upper case 4.

Figure 3:
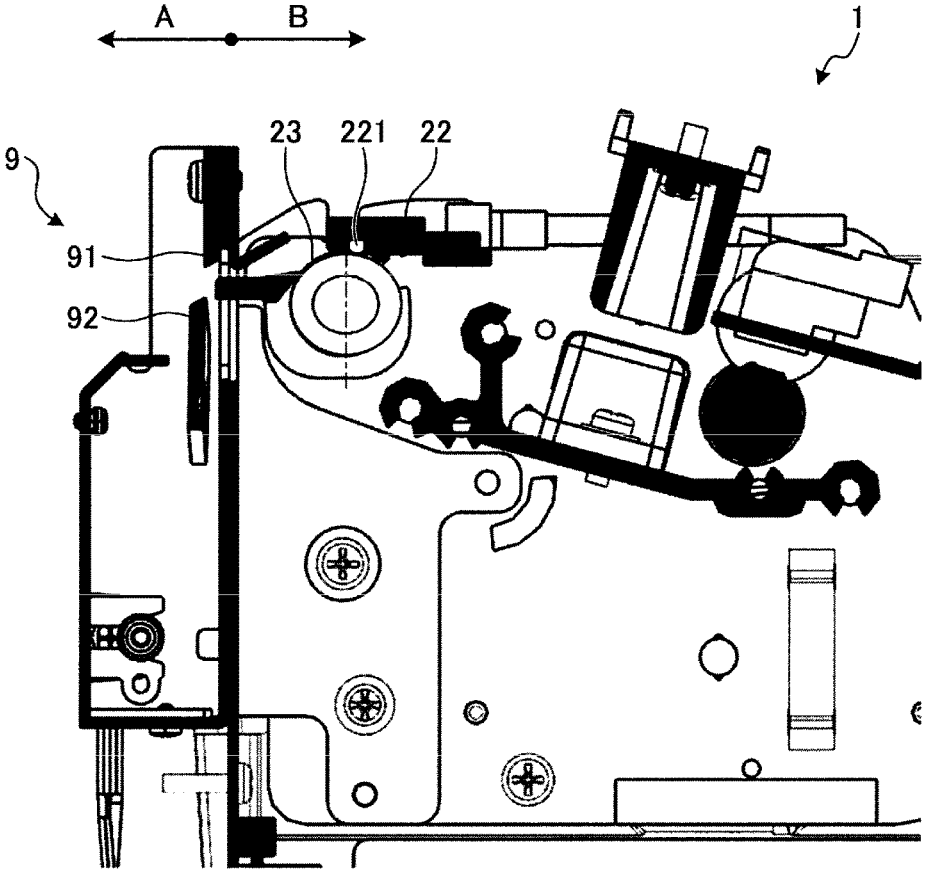
FIG. 3 is a right side view of a schematic configuration of the label printer of FIG. 1.

FIG. 3 is a right side view of a schematic configuration of the label printer 1. The printer main body 2 is provided with a printing head 22 and a platen roller 23. The printing head 22 and the platen roller 23 nip the backless label paper sheet L, and print the information on the printing surface of the backless label paper sheet L which is being conveyed.

The printing head 22 includes a heating body 221 upstream of the center of a nip area N (refer to FIG. 4) in the conveying direction (that is, in the B direction away from the center of the nip are N). The nip area N is defined between the printing head 22 and the platen roller 23.

Figure 4:
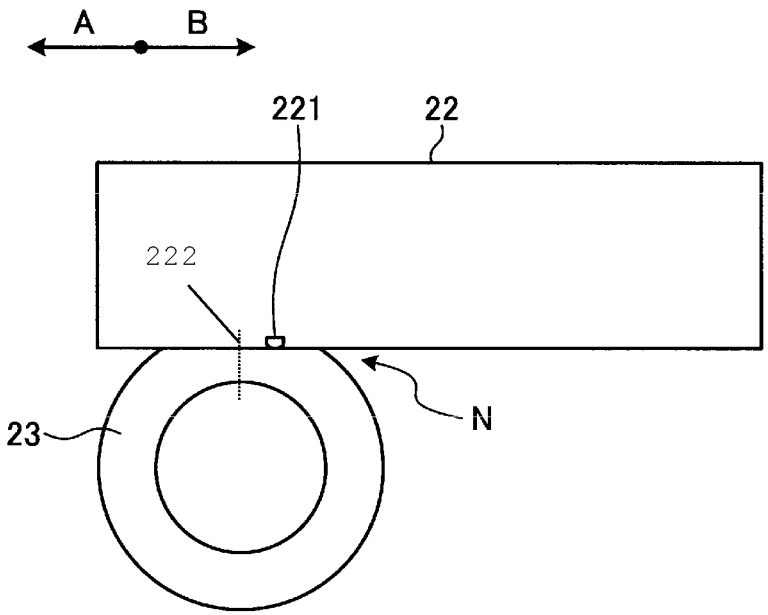
FIG. 4 illustrates a nip unit.

FIG. 4 illustrates the nip area N defined by the platen roller 23 and the printing head 22. The platen roller 23 is formed of an elastic material, such as rubber. Accordingly, the platen roller 23 may be deformed by being pushed against the printing head 22. In addition, the printing head 22 and the platen roller 23 nip the backless label paper sheet L. In other words, the nip area N is the area where the printing head 22 and the crushed platen roller 23 nip the backless label paper sheet L.

Returning to FIG. 3, the heating body 221 generates heat and melts ink which coats an ink ribbon (not illustrated). Accordingly, the printing head 22 functions as a printing unit and prints the information on the printing surface of the backless label paper sheet L conveyed by the platen roller 23. In addition, the heating body 221 may be located at a midpoint 222 of the nip area N, or may be located downstream of the midpoint 222 in the conveying direction (that is, in the A direction).

The platen roller 23 functions as a conveying unit, nips the backless label paper sheet L against the printing head 22, and conveys the backless label paper sheet L. At this time, the platen roller 23 presses the backless label paper sheet L to the printing head 22. Therefore, the platen roller 23 is formed of an insulating material, such as rubber, so that the adhesive side of the backless label paper sheet L does not stick to the platen roller 23. In addition, the platen roller 23 is rotated by a driving motor (not illustrated) which is driven in accordance with the control of a control unit 10 (refer to FIG. 7). Accordingly, the platen roller 23 can pull out a free end of the backless label paper sheet L, and conveys the backless label paper sheet L in the A direction toward the label discharge port 60 (FIG. 1).

In addition, the platen roller 23 can convey the backless label paper sheet L in the B direction, which is a reverse conveyance direction, to a position of the support unit 8 when a cutting unit 9 cuts the backless label paper sheet L and the control unit 10 (refer to FIG. 7) reverses the conveying direction of the backless label paper sheet L. Accordingly, the platen roller 23 can reverse convey the backless label paper sheet L.

The reverse conveying conveys the backless label paper sheet L in the B direction after the cutting unit 9 cuts the backless label paper sheet L on which the information is printed. In other words, after the cutting unit 9 cuts the backless label paper sheet L on which the information is printed, the backless label paper sheet L is conveyed to the platen roller 23 in the direction reverse to the direction of conveyance at the time when the printing head 22 prints the information. If subsequent information is printed without reverse conveying the sheet L, the region of backless label paper sheet L from the heating body 221 to the cutting unit 9 becomes a wasted region in which nothing is printed. Thus, the platen roller 23 can reduce waste of the backless label paper sheet L by performing the reverse feeding after the backless label paper sheet L is cut.

In addition, the label printer 1 is provided with the cutting unit 9 on a near side of the front cover 5 which is further than the platen roller 23 on the downstream side in the conveying direction. In addition, the cutting unit 9 cuts the backless label paper sheet L by a method using a so-called guillotine provided with a fixed blade 91 and a movable blade 92 which oppose each other on a paper sheet conveying path. The movable blade 92 of the cutting unit 9 is inclined from one end (upper side) to the other end (lower side). The cutting unit 9 moves the movable blade 92 with respect to the fixed blade 91, and makes the movable blade 92 slide along the width direction of the fixed blade 91. Accordingly, the cutting unit 9 cuts the backless label paper sheet L between the fixed blade 91 and the movable blade 92.

Figure 5:
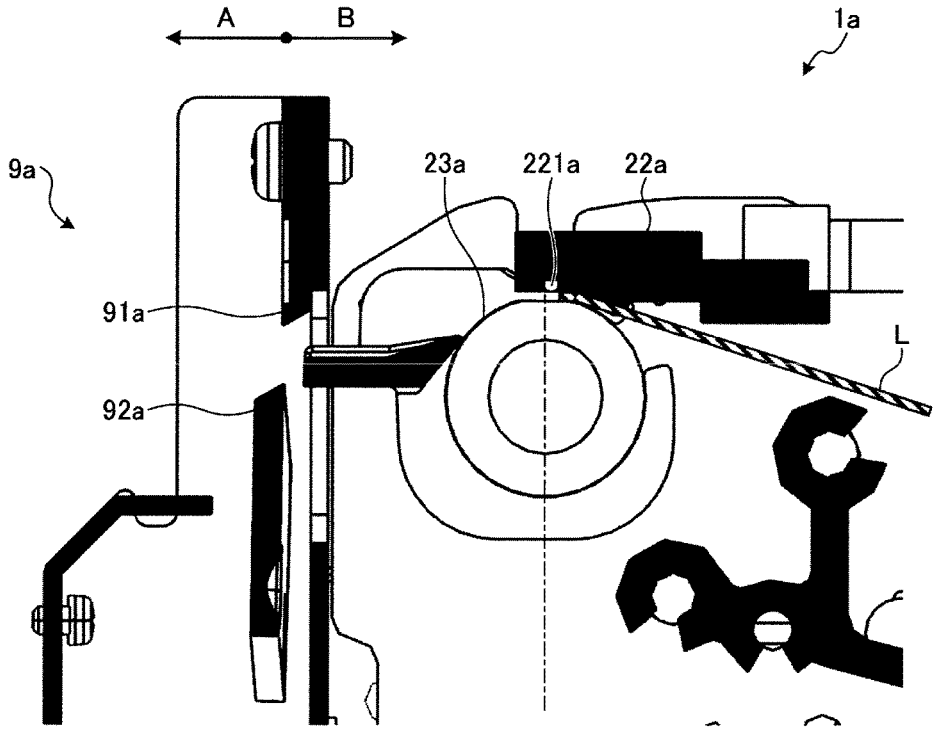
FIG. 5 (PRIOR ART)
FIG. 5 is a side view of the label printer of FIG. 1 illustrating a stop position of a backless label paper sheet according to a known reverse feeding method.
Figure 6:
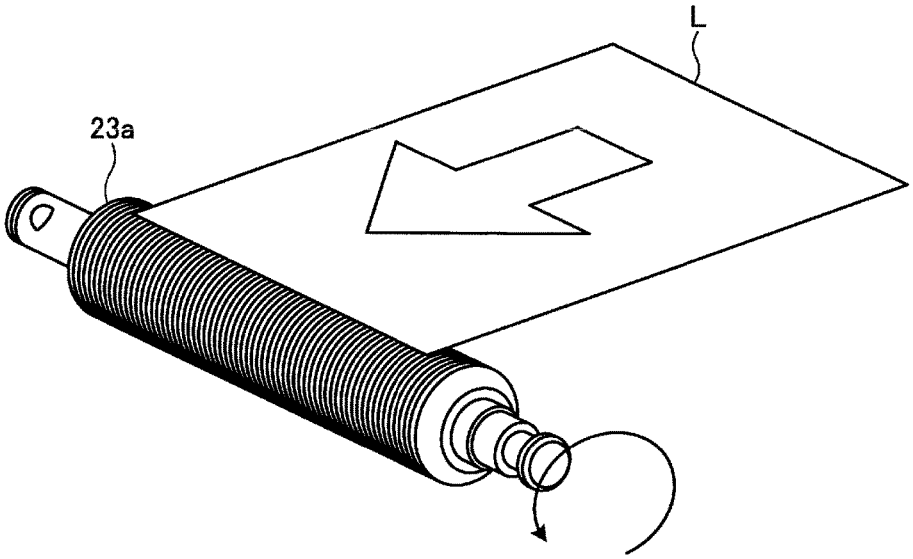
FIG. 6 (PRIOR ART)
FIG. 6 is a perspective view of a platen roller illustrating a stop position of a backless label paper sheet.

Next, a known reverse feeding method of the backless label paper sheet L performed by a label printer 1*a* will be described. Here, FIG. 5 is a side view of the label printer 1*a* illustrating a stop position of the backless label paper sheet L according to the known reverse feeding method. FIG. 6 is a perspective view of a platen roller 23*a* illustrating the stop position of the backless label paper sheet L according to the known reverse feeding method.

As illustrated in FIGS. 5 and 6, the label printer 1*a* in the known method stops the backless label paper sheet L on the upstream side in the paper sheet conveying direction of a heating body 221*a* after a cutting unit 9*a* provided with a fixed blade 91*a* and a movable blade 92*a* cuts the backless label paper sheet L. In addition, the label printer 1*a* stops the backless label paper sheet L at the center of the platen roller 23*a* after the reverse feeding. Accordingly, the label printer 1*a* in the known method reduces the useless region of the backless label paper sheet L by eliminating a region on which the information is not printed. However, there is a case where the backless label paper sheet L may adhere to a printing head 22*a*, so that the tip of the backless label paper sheet L is attached to the platen roller 23*a*.

Thus, the label printer 1 according to the first embodiment prevents the tip of the backless label paper sheet L from adhering and being attached to the platen roller 23 by adjusting a conveying amount of the backless label paper sheet L by the reverse conveying. Specifically, the control unit 10 (refer to FIG. 7) of the label printer 1 adjusts the conveying amount of the backless label paper sheet L by the reverse conveying.

Figure 7:
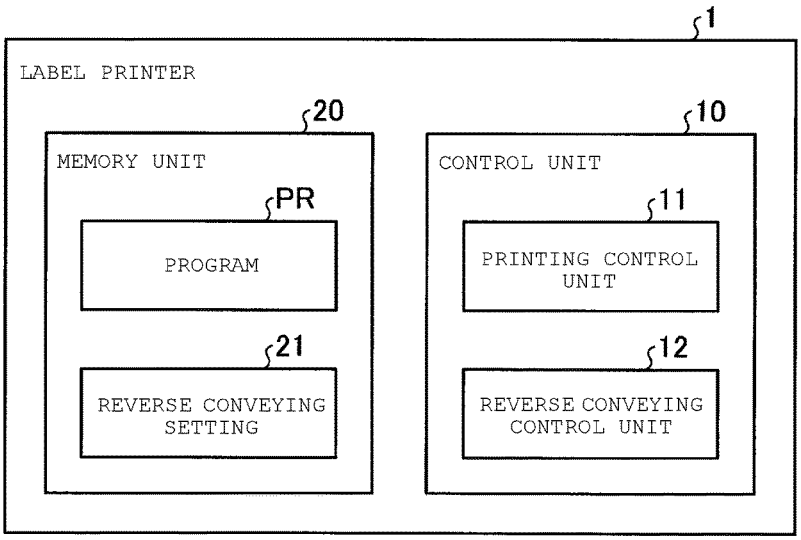
FIG. 7 is a block diagram illustrating an example functional configuration of the label printer of FIG. 1.

Next, functional aspects of the label printer 1 will be described. Here, FIG. 7 is a block diagram illustrating an example functional configuration of the label printer 1. The functions of the label printer 1 are controlled by the control unit 10 and a memory unit 20.

The control unit 10 controls each action, such as conveying, printing, or cutting of the backless label paper sheet L. The control unit 10 has a central processing unit (CPU) (not illustrated), a read only memory (ROM) (not illustrated), and a random access memory (RAM) (not illustrated). The ROM stores various programs or data. The RAM temporarily stores various programs, or rewrites various data.

The memory unit 20 is a memory device, such as a hard disk drive (HDD) or a solid state drive (SSD). The memory unit 20 stores a program PR and a reverse conveying setting 21. In addition, the memory unit 20 may be the ROM. The program PR is a program for achieving the functionality of the label printer 1.

The reverse conveying setting 21 is a setting of the position of the tip of the backless label paper sheet L after the reverse conveying. In other words, the reverse conveying setting 21 is the position of the tip of the backless label paper sheet L at which reverse conveying is stopped. That is, reverse conveying stops when the tip of the backless label paper sheet L reaches the position of the reverse conveying setting 21. For the reverse conveying setting 21, it is possible to set an arbitrary position as the position of the tip of the backless label paper sheet L after the reverse conveying. Therefore, in the reverse conveying setting 21, it is possible to set a position further than the heating body 221 on the downstream side in the conveying direction as the position of the tip end of the backless label paper sheet L. In addition, in the reverse conveying setting 21, it is possible to set a position of the midpoint 222 of the nip area N defined between the printing head 22 and the platen roller 23. In addition, in the reverse conveying setting 21, it is possible to set a position further than the nip area N on the downstream side in the conveying direction as the position of the tip of the backless label paper sheet L.

In addition, an example of the reverse conveying setting 21 is a position which is approximately 1 mm from an end of the nip area N on the downstream side in the conveying direction. In the case of such a setting, since the tip of the backless label paper sheet L is not stuck to the platen roller 23, it is possible to prevent the tip from being attached to the platen roller 23. In addition, the position which is approximately 1 mm from the end of the nip area N is an example, and may be equal to or greater than 1 mm, and may be equal to or less than 1 mm.

The control unit 10 of the label printer 1 operates each functional unit illustrated in FIG. 7 on the RAM by reading the program PR of the memory unit 20, and by operating in accordance with the program PR. In this manner, the control unit 10 includes a printing control unit 11 and a reverse conveying control unit 12, as functional units.

The printing control unit 11 controls the printing head 22 and thereby prints the information on the printing surface of the backless label paper sheet L, and controls the platen roller 23 and thereby conveys the backless label paper sheet L. In addition, the printing control unit 11 controls the cutting unit 9 and thereby cuts the backless label paper sheet L when the printing on the backless label paper sheet L is completed.

The reverse conveying control unit 12 controls the reverse conveying which conveys the backless label paper sheet L toward the platen roller 23 in a reverse conveying direction (opposite to the conveying direction) after the cutting unit 9 cuts the backless label paper sheet L. At this time, the reverse conveying control unit 12 conveys the backless label paper sheet L toward the platen roller 23 according to the reverse conveying setting 21. In other words, the reverse conveying control unit 12 does not convey the backless label paper sheet L to the platen roller 23 in the reverse conveying direction until the tip of the backless label paper sheet L is positioned further than the position of the reverse conveying setting 21 on the upstream side in the reverse conveying direction.

Specifically, the reverse conveying control unit 12 determines the position of the tip of the backless label paper sheet L to be further than the heating body 221 on the upstream side in the reverse conveying direction when the position of the heating body 221 provided in the printing head 22 is set as the reverse conveying setting 21. In other words, the reverse conveying control unit 12 determines the position of the tip of the backless label paper sheet L to be on the cutting unit 9 side with respect to the reverse conveying setting 21, further than the heating body 221 on the upstream side in the reverse conveying direction.

In addition, the reverse conveying control unit 12 determines the position of the tip of the backless label paper sheet L to be further than the midpoint 222 of the nip area N on the upstream side in the reverse conveying direction when the position of the midpoint 222 of the nip area N is set as the reverse conveying setting 21.

In addition, the reverse conveying control unit 12 determines the position of the tip of the backless label paper sheet L to be upstream in the reverse conveying direction from the end of the nip area N on the upstream side in the reverse conveying direction, when the end of the nip area N on the upstream side in the reverse conveying direction set as the reverse conveying setting 21.

In addition, the reverse conveying control unit 12 determines the position of the tip of the backless label paper sheet L to be at a position which is approximately 1 mm from the end of the nip area N on the upstream side in the reverse conveying direction, when the position which is approximately 1 mm from the end of the nip area N on the upstream side in the reverse conveying direction is set as the reverse conveying setting 21.

Figure 8:
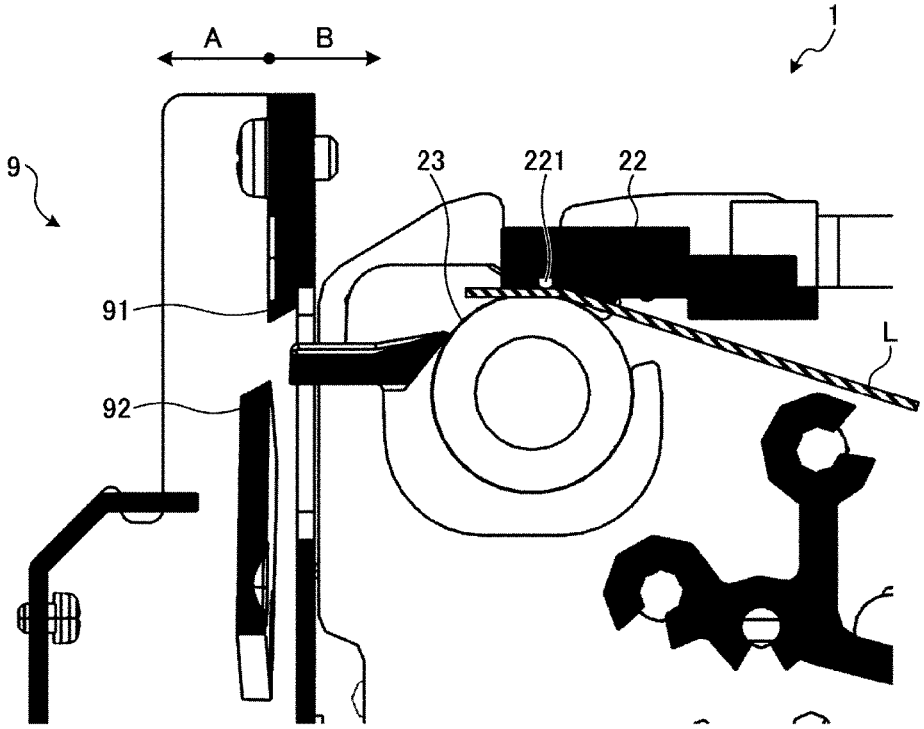
FIG. 8 is a side view of the label printer of FIG. 1 illustrating a stop position of a backless label paper sheet according to a reverse conveying method embodiment of the present disclosure.
Figure 9:
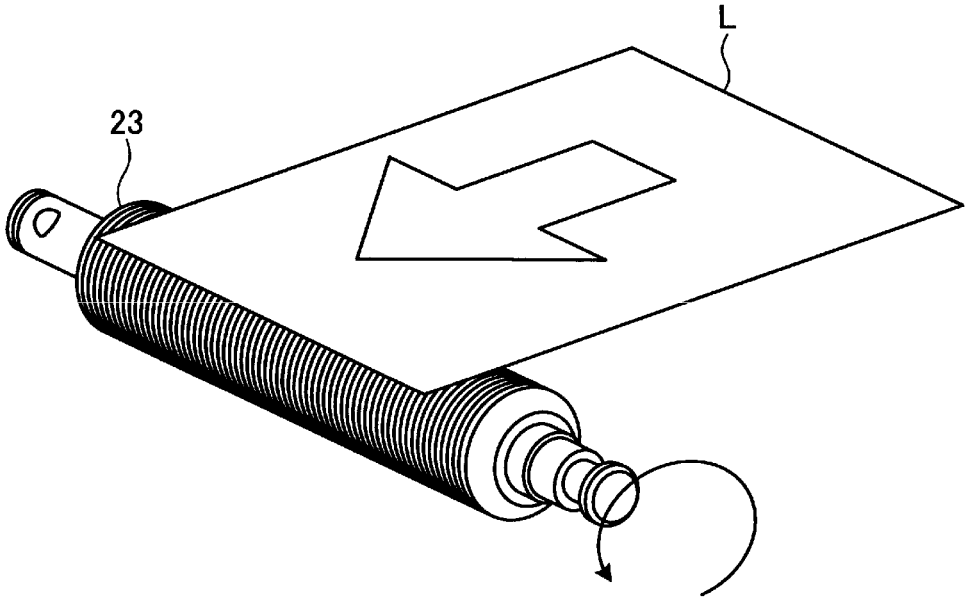
FIG. 9 is a perspective view of the platen roller of FIG. 6 illustrating a stop position of a backless label paper sheet according to the reverse conveying method embodiment of the present application.

FIG. 8 is a side view of the label printer 1 illustrating the stop position of the backless label paper sheet L according to the reverse conveying method. FIG. 9 is a perspective view of the platen roller 23 illustrating the stop position of the backless label paper sheet L according to the reverse conveying method.

As illustrated in FIGS. 8 and 9, the reverse conveying control unit 12 performs the reverse conveying so that the tip of the backless label paper sheet L is positioned further than the nip area N on the upstream side in the reverse conveying direction. Accordingly, the tip of the backless label paper sheet L is not pushed against the platen roller 23. In other words, the tip of the backless label paper sheet L does not come into contact with the platen roller 23. Therefore, it is possible to prevent the tip of the backless label paper sheet L from being attached to the platen roller 23. In addition, the stop position of the backless label paper sheet L illustrated in FIGS. 8 and 9 is the stop position of the tip of the backless label paper sheet L when the reverse conveying setting 21 is set at approximately 1 mm from the nip area N on the upstream side in the reverse conveying direction.

Figure 10:
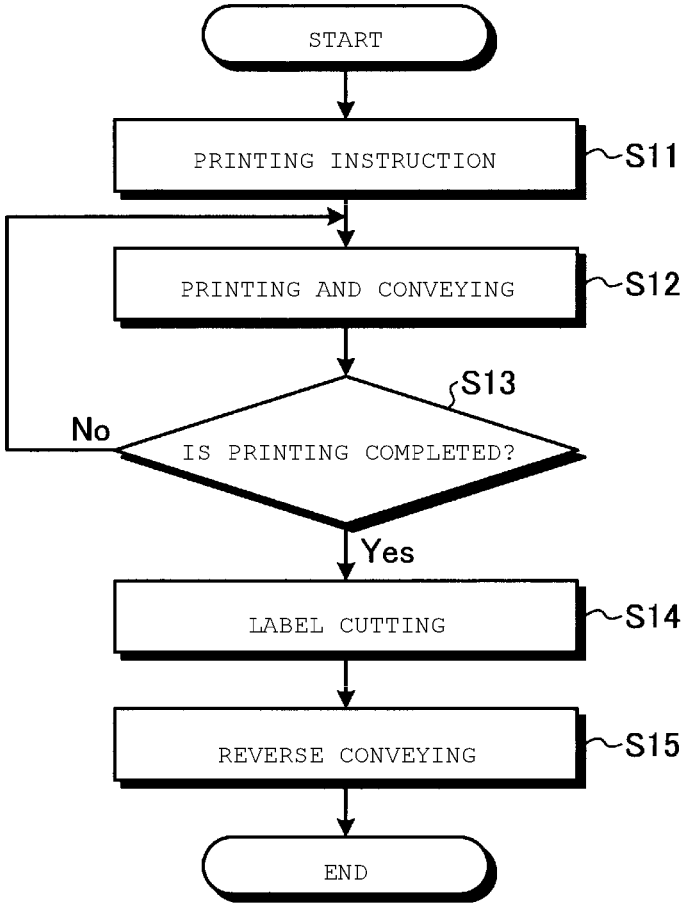
FIG. 10 is a flow chart view illustrating an example sequence of operations for printing processing performed by the label printer of FIG. 1.

Next, printing processing performed by the label printer 1 will be described. FIG. 10 is a flowchart view illustrating an example sequence of operations for the printing processing performed by the label printer 1.

First, the printing control unit 11 receives a printing instruction (step S11). Next, the printing control unit 11 controls the printing head 22 and prints the information received by the printing instruction on the printing surface of the backless label paper sheet L, and controls the platen roller 23 to convey the backless label paper sheet L on which printing is being performed (step S12).

Next, the printing control unit 11 determines whether or not the printing of the information received by the printing instruction is completed (step S13). When the printing is not completed (step S13: NO), the printing control unit 11 moves to step S12 and continues the printing.

When the printing is completed (step S13: YES), the printing control unit 11 controls the cutting unit 9 and cuts the backless label paper sheet L (step S14). Next, the reverse conveying control unit 12 controls the platen roller 23 and reverse conveys the backless label paper sheet L on which printing is being performed (step S15).

According to the above, the label printer 1 finishes the printing processing.

As described above, in the label printer 1 according to the first embodiment, the printing head 22 and the platen roller 23 nip the backless label paper sheet L, and convey the backless label paper sheet L while performing the printing. In addition, after the cutting unit 9 cuts the backless label paper sheet L, the reverse conveying control unit 12 conveys the backless label paper sheet L to the platen roller 23 to the upstream side in the reverse conveying direction. At this time, the reverse conveying control unit 12 determines the position of the tip of the backless label paper sheet L to be further than the heating body 221 provided in the printing head 22 on the upstream side in the reverse conveying direction. Therefore, the label printer 1 can prevent the tip end of the backless label paper sheet L from adhering to the platen roller 23.

Second Embodiment

Figure 11:
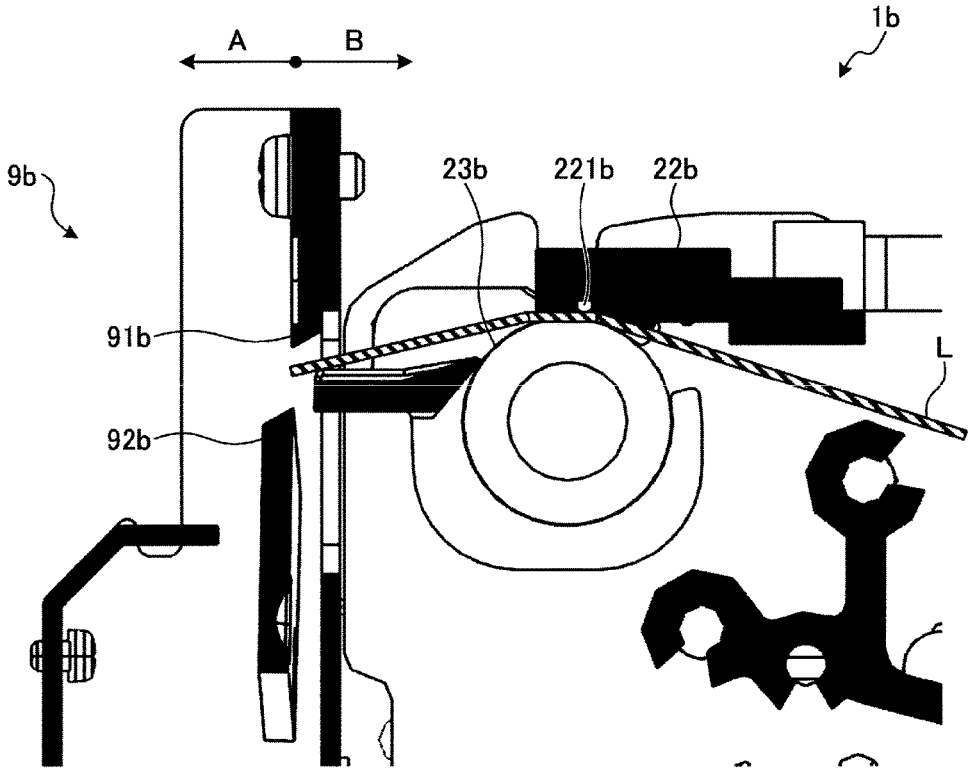
FIG. 11 is a side view of the label printer of FIG. 1 illustrating a stop position of the backless label paper sheet according to a reverse conveying method of a second embodiment of the present disclosure.

Next, a label printer 1*b* according to a second embodiment will be described. Here, FIG. 11 is a side view of the label printer 1*b* illustrating the stop position of the backless label paper sheet L according to the second embodiment.

The label printer 1 according to the first embodiment performs the reverse conveying and stands by for the next printing instruction after the cutting unit 9 cuts the backless label paper sheet L. The label printer 1*b* according to the second embodiment starts the reverse conveying when there is an instruction of printing subsequent information after a cutting unit 9*b* cuts the backless label paper sheet L. When the backless label paper sheet L is reverse conveyed immediately before the printing, a period during which the tip end of the backless label paper sheet L is in contact with a platen roller 23*b* is short. Accordingly, the possibility that the tip of the backless label paper sheet L adheres to the platen roller 23*b* decreases.

Figure 12:
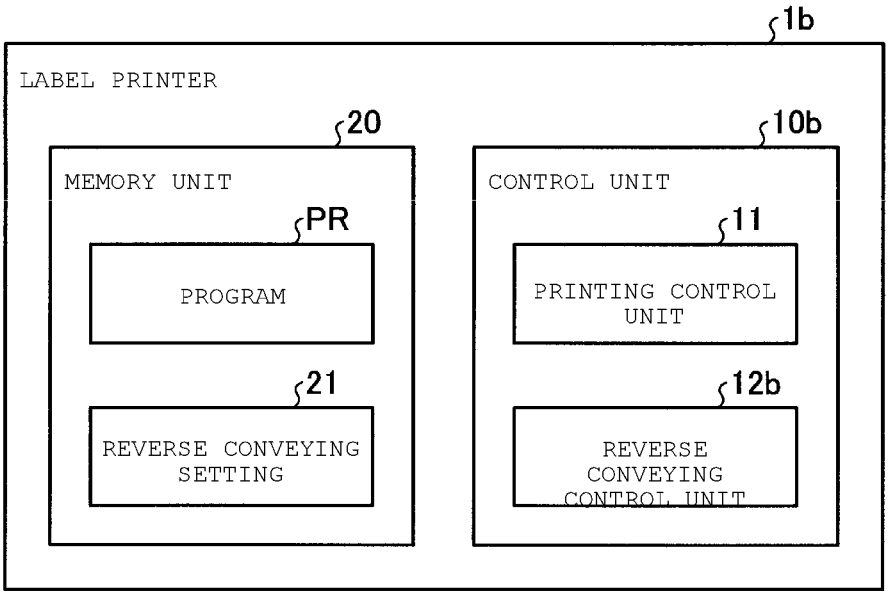
FIG. 12 is a block diagram illustrating an example functional configuration of a label printer according to the second embodiment.

FIG. 12 is a block diagram illustrating an example functional configuration of the label printer 1*b*. As illustrated in FIG. 12, the label printer 1*b* according to the second embodiment has a reverse conveying control unit 12*b* of a control unit 10*b* that is different from the reverse conveying control unit 12 of the label printer 1 according to the first embodiment. Specifically, as described above, the reverse conveying control unit 12*b* according to the second embodiment is different in that the reverse conveying is started after the next printing instruction is received.

Figure 13:
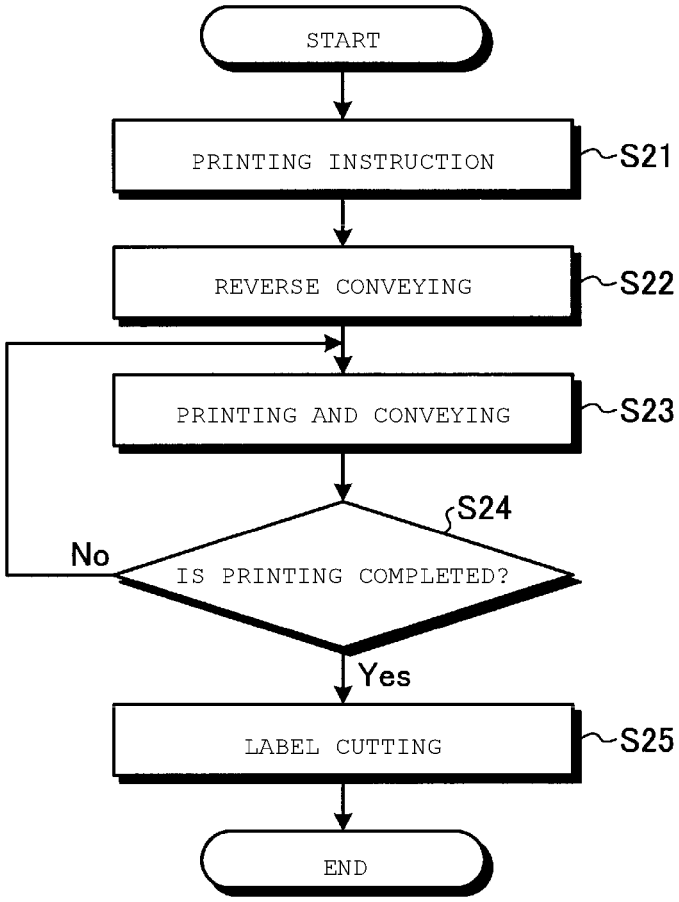
FIG. 13 is a flow chart view illustrating an example sequence of operations for printing processing performed by the label printer of FIG. 1 according to the second embodiment.

FIG. 13 is a flow chart view illustrating an example of the printing processing performed by the label printer 1*b*. The flow chart view illustrated in FIG. 13 is different from that of the label printer 1 according to the first embodiment in that the reverse conveying is performed after the printing instruction is received.

First, the printing control unit 11 receives the printing instruction (step S21). Next, the reverse conveying control unit 12*b* controls the platen roller 23*b* and revere feeds the backless label paper sheet L on which printing is being performed (step S22).

Next, the printing control unit 11 controls a printing head 22*b* and prints the information received by the printing instruction on the printing surface of the backless label paper sheet L, and controls the platen roller 23*b* to convey the backless label paper sheet L on which printing is being performed (step S23).

Next, the printing control unit 11 determines whether or not the printing of the information received by the printing instruction is completed (step S24). When the printing is not completed (step S24: NO), the printing control unit 11 moves to step S23 and continues the printing.

When the printing is completed (step S24: YES), the printing control unit 11 controls the cutting unit 9*b* and cuts the backless label paper sheet L (step S25).

According to the above, the label printer 1*b* finishes the printing processing.

The program executed by each apparatus according to the above-described embodiments or modification examples is provided being combined with the memory medium (ROM or memory unit) provided in each apparatus, but the disclosure is not limited thereto. For example, the program may be provided being recorded in a recording medium to be readable by a computer, such as a CD-ROM, a flexible disk (FD), a CD-R, or a digital versatile disk (DVD), in an installable file format or an executable file format. Furthermore, the recording medium is not limited to the medium which is independent from the computer or a combined system, and includes the memory medium in which storing or temporary storing is performed by downloading the program transmitted by a LAN or the Internet.

In addition, the program which is executed by each apparatus of the above-described embodiments or the modification examples thereof may be provided by accommodating the program on the computer connected to a network, such as the Internet, and by downloading the program via the network, or the program may be provided or distributed via a network, such as the Internet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A label printer comprising:

a support unit configured to support a roll of backless label sheet;

a printing unit including a print head positioned downstream of the support unit in a first conveying direction and configured to print on a surface of the backless label sheet;

a conveying unit including a roller that forms a nip area with the printing unit and configured to:

nip the backless label sheet between the roller and the printing unit, and convey the backless label sheet in the first conveying direction and in a second conveying direction opposite to the first conveying direction;

a cutting unit positioned downstream of the printing unit in the first conveying direction and configured to cut the backless label sheet;

a memory that stores a selection of one of a plurality of stop positions of a tip of the backless label sheet when the backless label sheet is conveyed in the second conveying direction; and a controller configured to control the conveying unit to convey the backless label sheet in the second conveying direction after the cutting unit cuts the backless label sheet and stop the conveyance of the backless label sheet in the second conveying direction so that the tip of the backless label sheet is stopped at the selected one of the stop positions.

2. The printer according to claim 1, wherein one of the stop positions is between the midpoint of the nip area and a downstream end of the nip area in the first conveying direction.

3. The printer according to claim 1, wherein one of the stop positions is downstream of a downstream end of the nip area in the first conveying direction.

4. The printer according to claim 1, wherein one of the stop positions is downstream of a midpoint of the nip area and upstream of the cutting unit in the first conveying direction.

5. The printer according to claim 1, wherein the conveying unit conveys the backless label sheet in the second conveying direction after the printing unit prints on the surface of the backless label sheet and the cutting unit cuts the backless label sheet, in response to a first printing instruction being received.

6. The printer according to claim 1, wherein one of the stop positions is approximately 1 mm from a downstream end of the nip area in the first conveying direction.

7. A method of printing a label comprising:

storing a selection of one of a plurality of stop positions of a tip of a backless label sheet;

conveying, with a conveying unit including a roller that forms a nip area with a printing unit, the backless label sheet from a roll in a first conveying direction by nipping the backless label sheet with the roller and the printing unit;

printing, with a print head of the printing unit, on a surface of the backless label sheet;

cutting, with a cutting unit positioned on a downstream side of the printing unit in the first conveying direction, the backless label sheet after completion of the printing;

conveying the backless label sheet in a second conveying direction opposite to the first conveying direction after cutting the backless label sheet; and stopping conveyance of the backless label sheet in the second conveying direction so that the tip of the backless label sheet is stopped at the selected one of the stop positions.

8. The method according to claim 7, wherein one of the stop positions is between the midpoint of the nip area and a downstream end of the nip area in the first conveying direction.

9. The method according to claim 7, wherein one of the stop positions is downstream of a downstream end of the nip area in the first conveying direction.

10. The method according to claim 7, wherein one of the stop positions is downstream of a midpoint of the nip area and upstream of the cutting unit in the first conveying direction.

11. The method according to claim 7, wherein the backless label sheet is conveyed in the second conveying direction after the printing unit prints on the surface of the backless label sheet and the backless label sheet is cut, in response to a first printing instruction being received.

12. The printer according to claim 7, wherein one of the stop positions is approximately 1 mm from a downstream end of the nip area in the first conveying direction.

* * * * *